US006412891B1

(12) United States Patent
Liang et al.

(10) Patent No.: US 6,412,891 B1
(45) Date of Patent: Jul. 2, 2002

(54) RELEASE MECHANISM FOR TELESCOPING SLIDE ASSEMBLY

(75) Inventors: Hsiu-Chiang Liang; Keng-Chin Chen; Chun-Chiang Wang, all of Kaohsiung (TW)

(73) Assignee: King Slide Works Co., Ltd. (TW)

( * ) Notice: Subject to any disclaimer, the term of this patent is extended or adjusted under 35 U.S.C. 154(b) by 0 days.

(21) Appl. No.: 09/820,752

(22) Filed: Mar. 30, 2001

(30) Foreign Application Priority Data

Jan. 5, 2001 (TW) ..... 90200189 U

(51) Int. Cl.[7] ..... A47B 88/00
(52) U.S. Cl. ..... 312/334.44; 312/333
(58) Field of Search ..... 312/334.44, 334.46, 312/334.47, 333; 384/21

(56) References Cited

U.S. PATENT DOCUMENTS 3,462,203 A * 8/1969 Del Vecchio ..... 312/334.47
5,405,195 A 4/1995 Hobbs
5,417,490 A * 5/1995 Hobbs et al. ..... 312/334.47
5,823,649 A * 10/1998 Hinrichs ..... 312/334.45
5,961,193 A 10/1999 Hobbs

* cited by examiner

*Primary Examiner*—Janet M. Wilkens

(57) ABSTRACT

A release mechanism for telescoping slide including an outer member and an inner member is provided. The mechanism comprises an elongate connection member slidably mounted on the inner member. Operation performed on the access end of connection member at outer end of the slide may be transmitted to a pivot member near inner end of the slide. Thus pivot member may be selectively locked or unlocked for stopping or enabling the relative movement of the inner and the outer members. The push-pull style manipulation of the connection member is advantageous for having the open access end. Further, the structure is simplified for facilitating manufacture.

12 Claims, 5 Drawing Sheets

RELEASE MECHANISM FOR TELESCOPING SLIDE ASSEMBLY

BACKGROUND OF THE INVENTION

1. Field of Invention

The present invention relates to the field of slides and more particularly to an improved release mechanism for telescoping slide assembly.

2. Related Art

Conventionally, a slide is widely employed to enable the relative movement of a drawer and a cabinet, a computer desk and a keyboard shelf, or the like. A conventional slide comprises an outer member and an inner member. For example in the drawer and cabinet configuration, outer member is fixedly attached to the wall of cabinet and inner member is fixedly attached to the side of drawer. Typically, a ball bearing mechanism is employed to interconnect above two members in a rolling relation. Hence, inner member may coaxially move respect to outer member. Thus drawer is permitted to remove to its maximum extension or retract into the cabinet. Conventionally, a stop mechanism such as latch is employed to lock the slide in a fully extended position when the slide reaches its maximum extension. At this time, inner and outer members are held in place by the latch. Hence, drawer supported by inner member is held in this place. Further, it is possible to detach drawer from cabinet by manually manipulating the latch if desired. One such latch based locking mechanism for slide is disclosed in U.S. Pat. Nos. 5,405,195 and 5,961,193. Each of both disclosed a release mechanism situated on the front of slide controllable to manipulate the rear of slide. It comprises a lever for unlocking a number of slides in a locked position. The lever is implemented as an elongate steel spring. One end of lever is at the extension direction of slide, while the other end is coupled to a latch inside the slide. Hence, user may depress the outer end of lever to lift a locking pin of latch at the other end by utilizing the well known lever principle. Thus the locked slide is disengaged from lever, resulting in an unlocking of slide. However, the previous design suffered from several disadvantages. For example, user may unintentionally press the outer end of lever to activate the unlocking of slide due to the open, manual pressing design. Also, it is complex in structure. Such previous design is primarily suitable to slides installed under a load (e.g., drawer), not for slides affixed to the sides of load. Moreover, such previous design is too bulky to install in many current cabinets.

SUMMARY OF THE INVENTION

It is therefore an object of the present invention to provide a release mechanism which is activated by pulling or pushing. A locking of a load supported by slide is made possible through a pivot member at an inner end of slide when the load is pulled to an outer end of slide. Alternatively, unlock the release mechanism for removing the load from a cabinet or pushing the load completely into the cabinet.

It is another object of the present invention to provide a simple and compact release mechanism for telescoping slide assembly.

The advantages of the present invention are realized by providing a release mechanism for telescoping slide including an outer member and an inner member. The mechanism comprises a stop member affixed to the outer member for stopping further outward movement of the inner member when reaching a predetermined use position; a connection member having an elongate shape and slidably mounted on the inner member, one access end of the connection member being open at an outer end of the slide, while the other end being formed as at least one rear cam; a pivot member including a pivot pin mounted on the inner member such that the pivot member is pivotal about the pivot pin, the pivot member being maintained either in a locked storage position or operable to pivot to an unlocked position by the activation of the rear cam of the connection member, a front surface, and a rear surface, both the front and the rear surfaces either being blocked by the stop member when the inner member moves to the use position, thus prohibiting a relative movement between the inner and the outer members, or when the pivot member is unlocked by the activated the rear cam the front and the rear surfaces being disengaged from the stop member, thus unlocking the inner member and the stop member; and an elastic member mounted on the inner member and biased to maintain the pivot member in the use, the locked storage, or the unlocked position.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become fully understood from the detailed description given hereinbelow illustration only, and thus are not limitative of the present invention, and wherein.

DETAILED DESCRIPTION OF THE INVENTION

Figure 1:
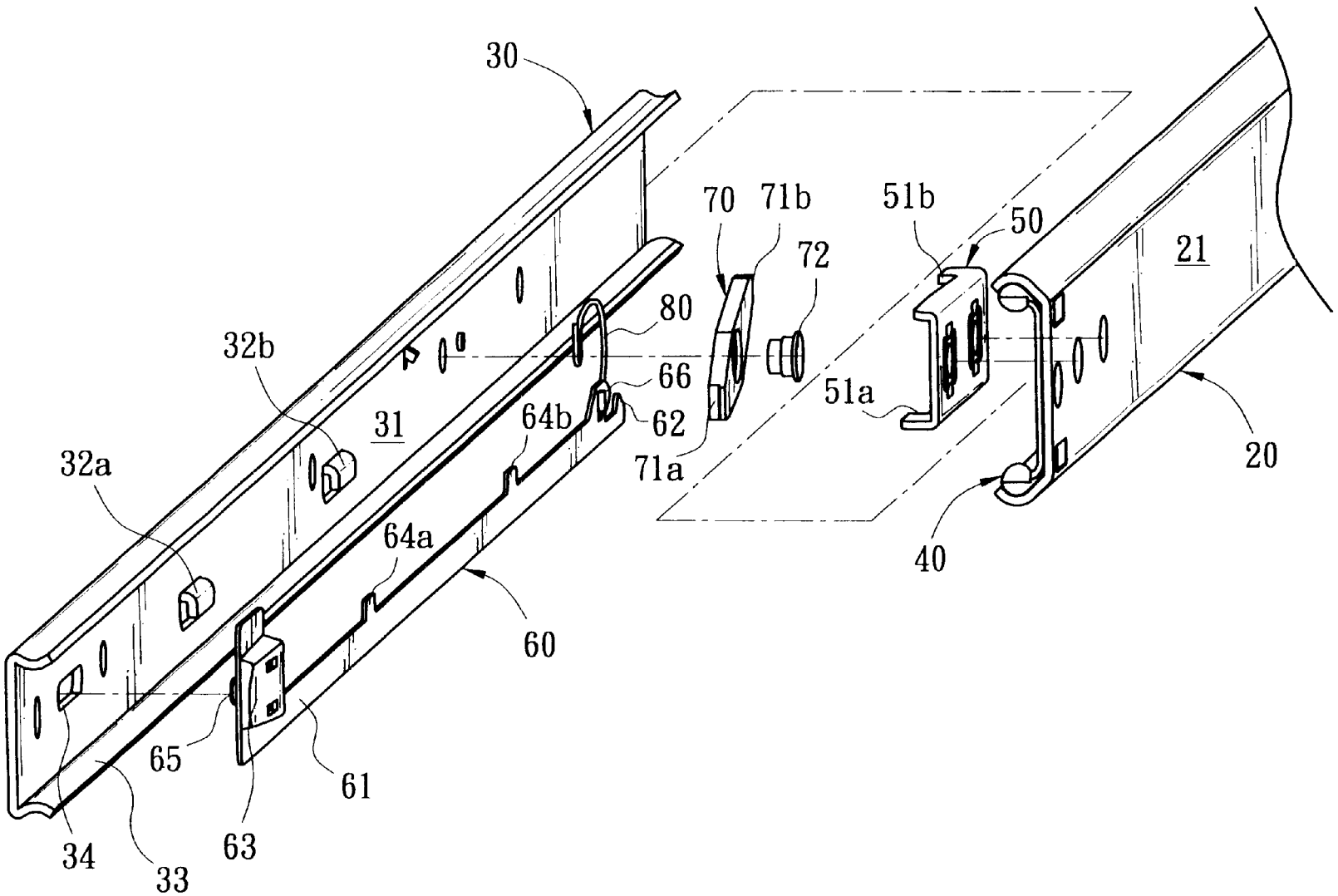
FIG. 1 is an exploded view of a first preferred embodiment of release mechanism mounted on a telescoping slide assembly according to the invention.
Figure 2:
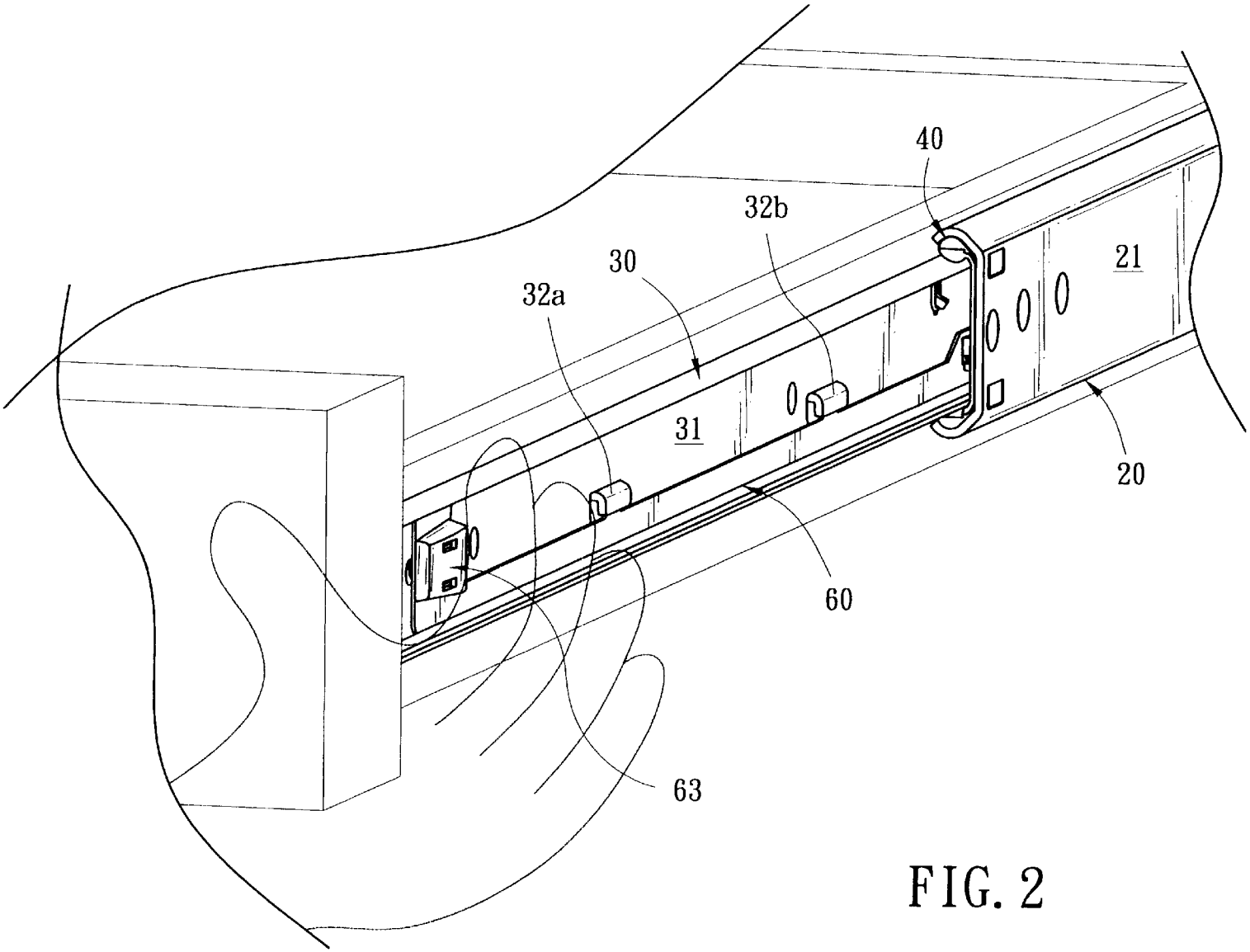
FIG. 2 is a perspective view of FIG. 1 illustrating a manual operation of the release mechanism adjacent the front side of drawer.
Figure 3A:
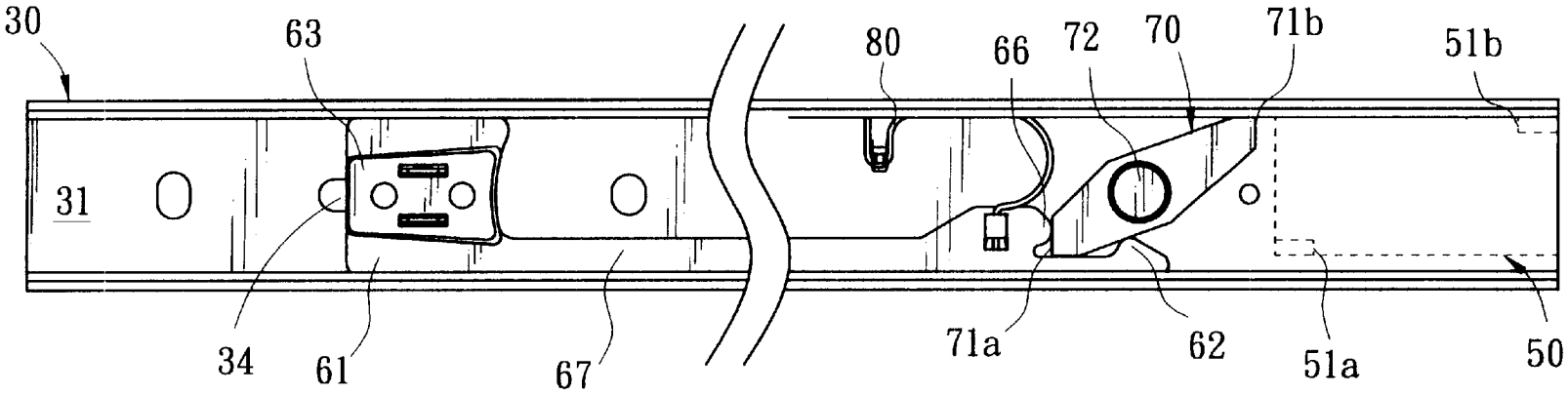
FIG. 3A is a side view illustrating the engagement of connection member and pivot member in a locked storage position.
Figure 3B:
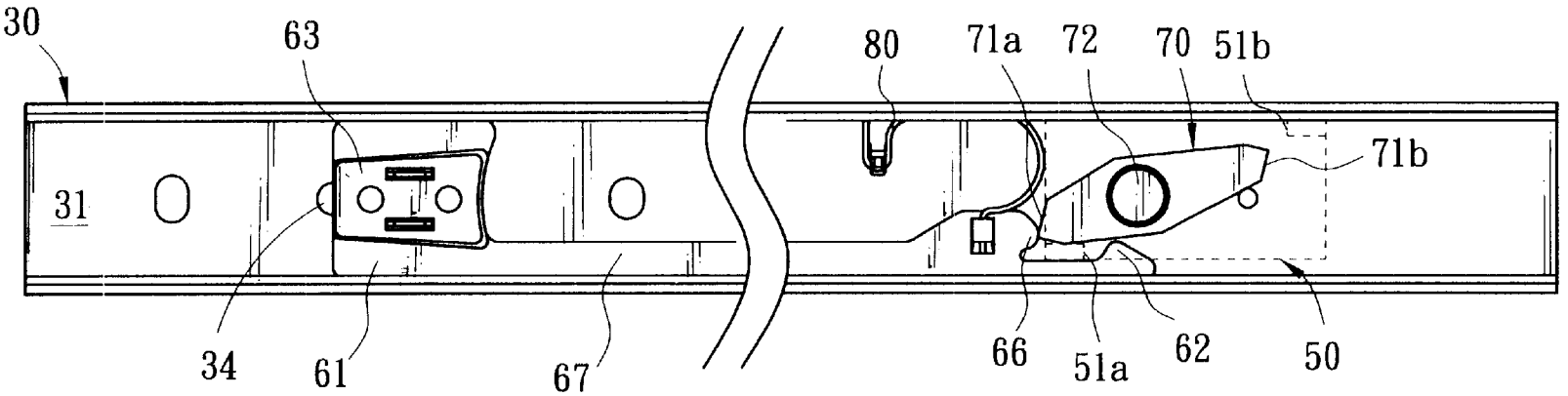
FIG. 3B is a view similar to FIG. 3A where inner member is about to reach a fully extended use position with pivot member about to pass a stop member.
Figure 3C:
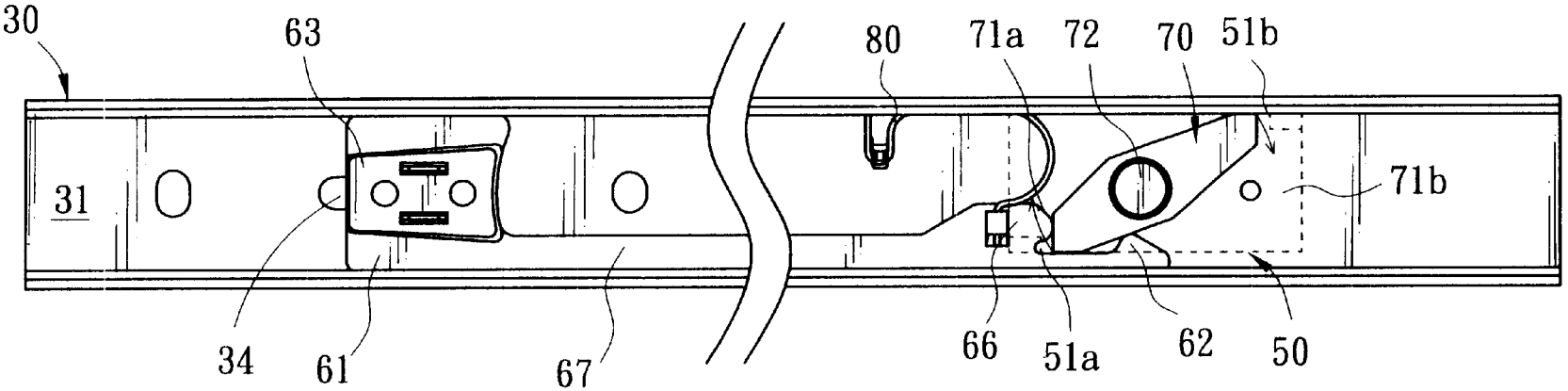
FIG. 3C is a view similar to FIG. 3A where inner member has reached the use position with pivot member and stop member engaged to stop a relative movement between inner and outer members.
Figure 3D:
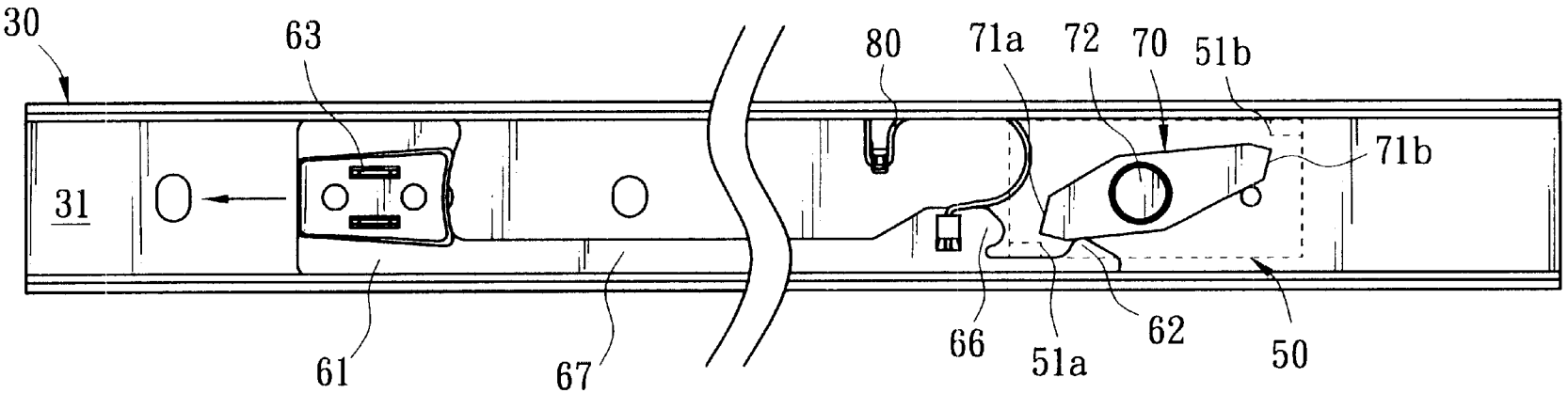
FIG. 3D is a view similar to FIG. 3A where pivot member is unlocked by the activated rear cam of connection member, resulting in a disengagement of inner and outer members.

Referring to FIGS. 1 to 3, there is shown a telescoping slide assembly incorporating a release mechanism constructed in accordance with the invention. Slide comprises an outer member 20 and an inner member 30. This embodiment is implemented in a drawer and a cabinet combination wherein two pair of slides are employed to effectuate a relative sliding movement therebetween. Outer member 20 is affixed to the wall of cabinet. Inner member 30 is affixed to either side of drawer. Inner member 30 is slidably received in outer member 20. Typically, a ball bearing mechanism (e.g., ball bearings 40) is employed to interconnect inner and outer members 20 and 30. Hence, inner member 30 may coaxially move respect to outer member 20. When drawer is pulled out to its maximum extension, slide is also extended to a fully extended use position. Alternatively, user may retract the drawer into cabinet. Hence, the release mechanism of the invention may be activated so as to effect a locking of drawer when drawer is pulled to the fully extended use position. Alternatively, unlock inner member 30 and outer member 20 for removing drawer from cabinet or pushing drawer completely into the cabinet. The components of the release mechanism are as follows:

Stop member 50 is affixed to outer member 20 for stopping further outward movement of inner member 30 when reaching a predetermined use position. Connection member 60 has an elongate shape and is mounted on inner wall of inner member 30. Connection member 60 may slide back and forth lengthwise on inner member 30. One end 61 of connection member 60 is open at an outer end of slide for ease of access by hand, while the other end is formed as at least one rear cam 62. Pivot member 70 comprises a pivot pin 72 mounted on inner wall of inner member 30 such that pivot member 70 may pivot about pin 72. Pivot member 70 is maintained in a locked storage position as shown in FIG. 3A. Pivot member 70 is also possible of pivoting to an unlocked position by the activation of rear cam 62 of connection member 60 (FIG. 3D). Pivot member 70 further comprises a front surface 71*a* and a rear surface 71*b* which are blocked by stop member 50 when inner member 30 moves to a use position (FIG. 3C). Thus a relative movement between inner member 30 and outer member 20 is prohibited. To the contrary, when pivot member 70 is unlocked by the activated rear cam 62, the front and rear surfaces 71*a* and 71*b* are disengaged from stop member 50, thus unlocking inner member 30 and stop member 50 (FIG. 3D). Then user may push drawer into cabinet or remove drawer from cabinet. Elastic member 80 is mounted on inner member 30 and biased to maintain pivot member 70 in any of above positions. It is apparent of being possible for the provision of a single front surface 71*a* on pivot member 70 in another implementation. Likewise, inner member 30 is blocked by the front surface 71*a* from further movement when reaching the predetermined use position. Alternatively, when pivot member 70 is unlocked by the activated rear cam 62, the front surface 71*a* is disengaged from stop member 50, thus unlocking inner member 30 and stop member 50 (FIG. 3D). Then user may remove drawer from cabinet.

In the embodiment, stop member 50 is an independent member mounted on outer member 20, i.e., on the inner wall of outer member 20 facing pivot member 70. Stop member 50 comprises a pair of spaced front first locking lugs 51*a* and a pair of spaced rear second locking lugs 51*b*. Such locking lugs 51*a* and 51*b* are corresponding to surfaces 71*a* and 71*b* of pivot member 70 respectively. When inner member 30 is about to reach the fully extended use position (FIG. 3B), pivot member 70 is approaching locking lug 51*b*. Then pivot member 70 passes locking lug 51*b* to reach the use position (FIG. 3C). At this time, surfaces 71*a* and 71*b* of pivot member 70 are situated between and stopped by locking lugs 51*a* and 51*b* of stop member 50, thus stopping a further movement of inner member 30. Preferably, in the position shown in FIG. 3A or FIG. 3C, surfaces 71*a* and 71*b* are perpendicular to locking lugs 51*a* and 51*b* respectively. Also, surfaces 71*a* and 71*b* and locking lugs 51*a* and 51*b* are perpendicular to the sliding direction of inner member 30, thereby ensuring a sliding secure relationship between inner member 30 and outer member 20.

In another implementation of stop member 50, locking lugs 51*a* and 51*b* are formed by punching on inner wall 21 of outer member 20. The projecting direction of each of locking lugs 51*a* and 51*b* is toward pivot member 70. It is unnecessary to additionally manufacture an independent stop member 50 as shown in FIG. 1. Thus, the number of components is further reduced.

Figure 4:
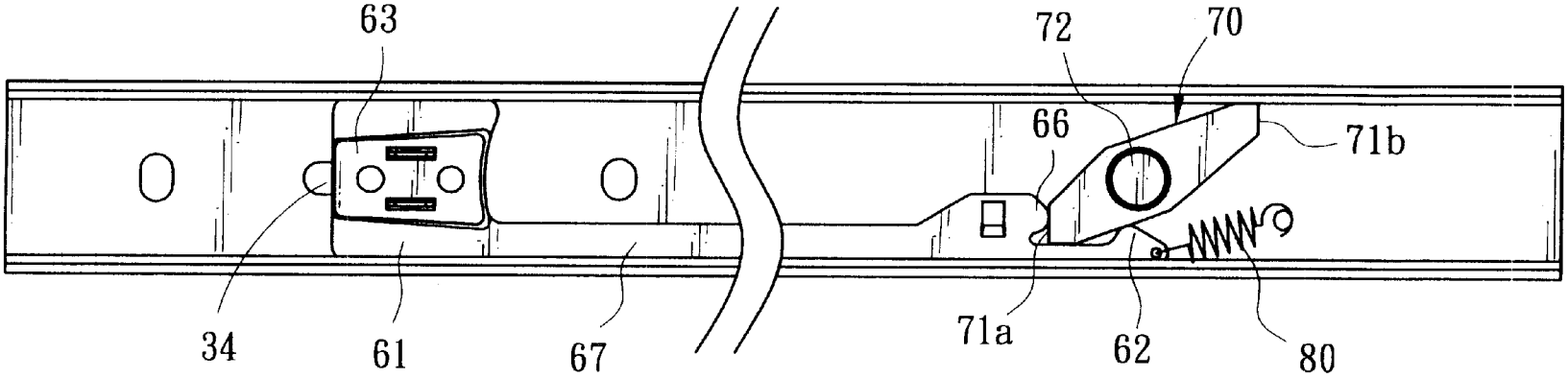
FIG. 4 is a second preferred embodiment of release mechanism mounted on a telescoping slide assembly according to the invention.

In the first embodiment, connection member 60 is an elongate thin member 60 which may be formed by punching on a suitable metal. As shown in FIG. 1, an enlargement 63 is mounted on outer end 61 of connection member 60. Preferably, enlargement 63 is formed of plastic material and is clung to threadedly secure to the outer end 61. The provision of enlargement 63 may facilitate user to push or pull connection member 60. Further, a plurality of hooks 32*a* and 32*b* are provided on inner wall 31 of inner member 30. Furthermore, the same number of tabs (e.g., 64*a* and 64*b*) are provided on a side of connection member 60. Tabs 64*a* and 64*b* are received in hooks 32*a* and 32*b* for mounting connection member 60 on inner member 30. Thus connection member 60 may slide on inner wall 31 of inner member 30 back and forth. Then fixedly attach both ends of elastic member 80 to inner member 30 and connection member 60 respectively for ensuring a sliding secure relationship between connection member 60 and inner member 30. In the embodiment, elastic member 80 is formed of flexible metal wire and has one end affixed to inner member 30 and the other end affixed to connection member 60. A slide travel limitation mechanism is provided. As shown, an elongate opening 34 is provided near the outer end of inner member 30 and a locking pin 65 is provided on connection member 60. Locking pin 65 is slidably received in opening 34. As such, a uniform elastic force provided by elastic member 80 is exerted on connection member 60 when outer member 20 is pulled outwardly. Also, connection member 60 is prevented from further moving when outer member 30 has reached the use position because the confinement of locking pin 65 in opening 34. This can avoid any potential irregularity. A front cam 66 is provided on the inner end of connection member 60 adjacent rear cam 62 for transmitting the elastic force of elastic member 80 to pivot member 70 through connection member 60. Front cam 66 is urged against the front surface 71*a* of pivot member 70 for pushing pivot member 70 to the locked (i.e., storage) position (FIG. 3A). Since connection member 60 is an elongate thin member, it is preferred to suitably increase the thickness of pivot member 70 for avoiding front cam 66 from interfering the engagement of the front surface 71*a* and second locking lug 51*b* of stop member 50. This may also increase the area of the front surface 71*a*. Moreover, elastic member 80 may be implemented as a helical spring in the second embodiment (FIG. 4) rather than a metal wire.

Figure 5:
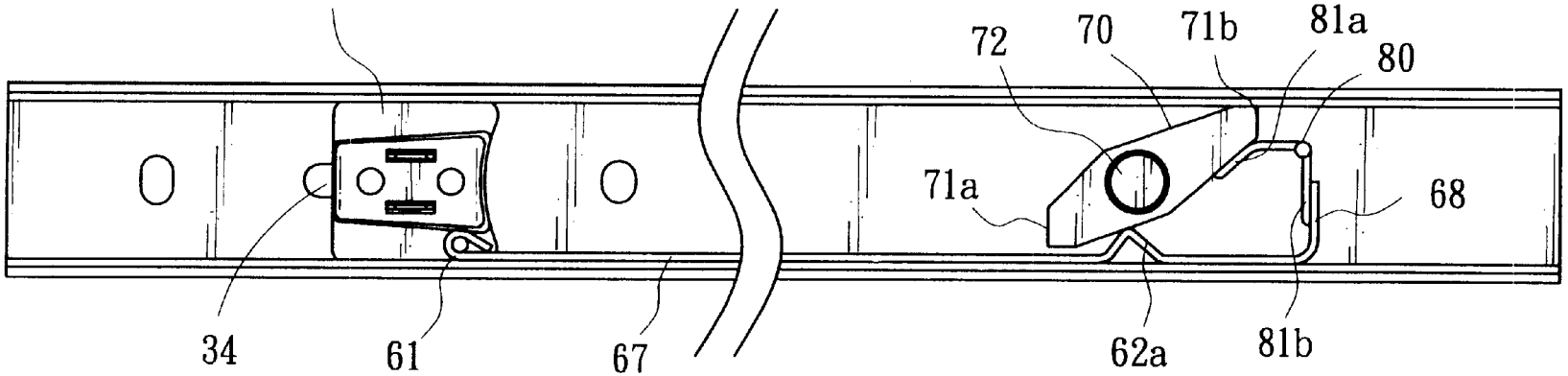
FIG. 5 is a third preferred embodiment of release mechanism mounted on a telescoping slide assembly according to the invention.

Referring to FIG. 5, a third embodiment of the invention is shown. Connection member 60 is implemented as a steel wire assembly 67 rather than a thin elongate member. Likewise, the steel wire assembly 67 comprises an outer end 61 for ease of access by hand and an enlargement 63. Additionally, the steel wire assembly 67 comprises a projected rear cam 62*a* formed by punching thereon near the inner end and an upward bent inner end 68. Elastic member 80 is also reconfigured to have its central portion affixed to inner member 30 and two ends 81*a* and 81*b* biased against pivot member 70 for maintaining pivot member 70 at a locked storage position and the upward bent inner end 68 for maintaining the steel wire assembly in a ready position (i.e., pivot member 70 is not activated) respectively.

The invention being thus described, it will be obvious that the same may be varied in many ways. For example, slide may comprise inner member 30, outer member 20 and intermediate member. Such variations are not to be regarded as a departure from the spirit and scope of the invention, and all such modifications as would be obvious to one skilled in the art are intended to be included within the scope of the following claims.

What is claimed is:

1. A release mechanism for a telescoping slide including an outer member and an inner member, said mechanism comprising:

a stop member affixed to said outer member for stopping further outward movement of said inner member when reaching a predetermined use position;

a connection member having an elongate shape and slidably mounted on said inner member, one access end of said connection member being open at an outer end of said slide, while said other end being formed as at least one rear cam;

a pivot member including a pivot pin mounted on said inner member such that said pivot member is pivotal about said pivot pin, said pivot member being maintained either in a locked storage position or operable to pivot to an unlocked position by said activation of said rear cam of said connection member, a front surface, and a rear surface, both said front and said rear surfaces either being blocked by said stop member when said inner member moves to said use position, thus prohibiting a relative movement between said inner and said outer members, or when said pivot member is unlocked by said activated said rear cam said front and said rear surfaces being disengaged from said stop member, thus unlocking said inner member and said stop member; and an elastic member mounted on said inner member and biased to maintain said pivot member in said use, said locked storage, or said unlocked position.

2. The release mechanism of claim 1, wherein said stop member is affixed to a predetermined position on said outer member facing said pivot member, and said stop member comprises a pair of spaced front first locking lugs engaged with said front surface for preventing said inner and said outer members from disengaging in said use position.

3. The release mechanism of claim 1, wherein said stop member is formed on an inner wall of said outer member, and said stop member comprises a pair of spaced front first locking lugs facing the pivot member, and said front first locking lugs being engaged with said front surface for preventing said inner and said outer members from disengaging in said use position.

4. The release mechanism of claim 1, wherein said stop member is affixed to said inner wall on said outer member facing said pivot member, and said stop member comprises a pair of spaced front first locking lugs and a pair of spaced rear second locking lugs, each of said locking lugs corresponding to and engaged with said front and said rear surfaces of said pivot member respectively for stopping said relative movement of said inner and said outer members in said use position.

5. The release mechanism of claim 1, wherein said stop member is formed on said inner wall of said outer member, and said stop member comprises a pair of spaced front first locking lugs and a pair of spaced rear second locking lugs facing pivot member, each of said locking lugs corresponding to and engaged with said front and said rear surfaces of said pivot member respectively for stopping said relative movement of said inner and said outer members in said use position.

6. The release mechanism of claim 1, wherein said connection member has an elongate thin shape, further comprising an enlargement mounted on said access end of said connection member.

7. The release mechanism of claim 1, wherein said connection member further comprises a front cam urged against said front surface of said pivot member for pushing said pivot member to said locked storage position.

8. The release mechanism of claim 1, wherein said elastic member is a flexible metal wire, said elastic member having one end affixed to said inner member and said other end affixed to said connection member.

9. The release mechanism of claim 1, wherein said elastic member is a helical spring, said elastic member having one end affixed to said inner member and said other end affixed to said connection member.

10. The release mechanism of claim 1, wherein said connection member is a steel wire assembly, said steel wire assembly comprising an access member at said outer end, an enlargement, a projected rear cam member formed by punching thereon, and an upward bent member at said inner end biased by said elastic member.

11. The release mechanism of claim 10, wherein said central portion of said elastic member is affixed to said inner member and said ends of said elastic member are biased against said pivot member and said upward bent member respectively so that said pivot member is maintained at said locked storage position and said steel wire assembly is maintained at in a ready position when said pivot member is not activated.

12. The release mechanism of claim 1, further comprising an elongate opening on said inner wall of said inner member and a locking pin on said connection member being slidably received in said elongate opening so as to be confined therein.

* * * * *